US005799899A

United States Patent [19]

Wells et al.

[11] Patent Number: 5,799,899

[45] Date of Patent: Sep. 1, 1998

[54] ERROR DETECTOR APPARATUS WITH DIGITAL COORDINATE TRANSFORMATION

[75] Inventors: Michael L. Wells, Newhall; John A. Tyson, Lawndale; Richard J. Sand, Torrance; Glenn S. Higa, Carson; Jane L. Pauwels, Harbor City, all of Calif.

[73] Assignee: Hughes Electronics, El Segundo, Calif.

[21] Appl. No.: 888,613

[22] Filed: Jul. 7, 1997

Related U.S. Application Data

[63] Continuation of Ser. No. 340,135, Nov. 15, 1994, abandoned.

[51] Int. Cl.[6] ..... F41G 7/00

[52] U.S. Cl. ..... 244/3.11

[58] Field of Search ..... 244/3.11, 312, 244/3.13, 3.14, 3.15, 3.16, 3.19

[56] References Cited

U.S. PATENT DOCUMENTS

| | | | |
|---|---|---|---|
| 3,114,859 | 12/1963 | Fathauer et al. . | |
| 3,796,396 | 3/1974 | Crovella | 244/3.11 |
| 3,974,383 | 8/1976 | Chapman | 244/3.11 |
| 3,989,974 | 11/1976 | Chapman | 250/338 |
| 3,992,629 | 11/1976 | Chapman . | |
| 4,008,869 | 2/1977 | Weiss | 244/3.13 |
| 4,037,202 | 7/1977 | Terzian | 244/3.11 |
| 4,300,736 | 11/1981 | Miles | 244/3.13 |
| 4,406,429 | 9/1983 | Allen . | |
| 4,529,151 | 7/1985 | Skarman | 244/3.15 |
| 4,634,271 | 1/1987 | Jano et al. | 244/3.13 |
| 4,641,801 | 2/1987 | Lynch, Jr. et al. | 244/3.11 |
| 4,696,441 | 9/1987 | Jones et al. | 244/3.13 |
| 4,923,276 | 5/1990 | Wells | 244/3.16 |
| 5,042,742 | 8/1991 | Hufault et al. | 244/3.11 |
| 5,042,743 | 8/1991 | Carney . | |
| 5,061,930 | 10/1991 | Nathanson et al. | 244/3.13 |
| 5,062,586 | 11/1991 | Hobson et al. . | |
| 5,102,064 | 4/1992 | Daly | 244/3.11 |
| 5,414,430 | 5/1995 | Hansen | 244/3.11 |
| 5,426,435 | 6/1995 | Moore et al. | 342/68 |
| 5,651,512 | 7/1997 | Sand et al. | 244/3.13 |

FOREIGN PATENT DOCUMENTS

| | | |
|---|---|---|
| A-0399862 | 11/1990 | European Pat. Off. . |
| 2 184313 | 6/1987 | United Kingdom . |

OTHER PUBLICATIONS

"Principles of Guided Missile Design", G. Merrill, Editor. Princeton, N.J.: 1955, pp. 664–668, Sep. 1955.

*Primary Examiner*—Charles T. Jordan
*Assistant Examiner*—Theresa M. Wesson
*Attorney, Agent, or Firm*—Leonard A. Alkov; William C. Schubert; Glenn H. Lenzen, Jr.

[57] ABSTRACT

An error detector apparatus (42) producing a signal used in the computation of a missile guidance signal in an aircraft-based missile guidance and tracking system. The error detector apparatus (42) incorporates means (146), (148), (150), (152), and (154) for producing a first envelope signal from a tracking signal emitted by a missile. The envelope signal is then converted, along with a reference signal, to a digital signal by an analog to digital converter (158). A microcontroller (168) calculates an error correction signal from the digital signals. A digital to analog converter (160) converts the digital error correction signal to an analog error correction signal and outputs the analog error correction signal to the system for use in computing a missile guidance signal.

22 Claims, 5 Drawing Sheets

ERROR DETECTOR APPARATUS WITH DIGITAL COORDINATE TRANSFORMATION

This is continuation of application Ser. No. 08/340,135 filed Nov. 15, 1994 now abandoned.

This invention was made with Government support under Contract No. F04606-90-D-004 awarded by the United States Air Force. The Government has certain rights in this invention.

BACKGROUND OF THE INVENTION

1. Technical Field

This invention relates generally to an aircraft-based missile guidance and tracking system, and more particularly to an error detector for increasing the accuracy of a missile guidance and tracking system.

2. Discussion

Conventional aircraft-based missile guidance and tracking systems utilize targeting technology referred to as command to line of sight technology. This technology allows a system operator to fire a missile from an aircraft and guide the missile to an intended target. Such systems greatly increase the probability that a missile fired from an aircraft will successfully reach its target.

The visual feedback in the above-mentioned missile guidance and tracking systems is typically supplied through telescope-based optics, such as the optics disclosed in U.S. Pat. No. 3,989,947 to Chapman, entitled "Telescope Cluster". As disclosed in Chapman, an operator of such a system visually locates an intended target through one of the system telescopes. After locating the target, the operator manipulates the optics to position the image of the target between the intersection of horizontal and vertical cross-hairs of the optics and fires the missile. The operator effectively guides the missile to the target by maintaining the target image position between the intersection of the cross-hairs.

As the operator maintains the target image position at the intersection of the cross hairs, system optics also track the missile through detection of a missile tracking signal, which is typically the infrared radiation emitted from a source in the missile. An error computer in the guidance and tracking system processes the optically detected tracking signal and determines if the missile has deviated from its intended target. If the missile has deviated from its intended target, the system, through a missile guidance signal transmitted to the missile, steers the missile back on course.

Presently, error computers in typical missile guidance and tracking systems process tracking signals through analog components. However, these analog components, while providing approximate error correction signals, are limited in both accuracy and flexibility of application. Further, the analog components typically implemented in such a system are often expensive and difficult to obtain.

What is needed then is an error detector computer which does not suffer from the aforementioned limitations associated with analog error detection computers and which can be constructed with relatively inexpensive, easy to obtain components.

SUMMARY OF THE INVENTION

In accordance with the teachings of the present invention, an error detector computer is provided for use in computing a missile guidance signal. The error detector computer finds particular utility in aircraft-based missile guidance and tracking systems that include a sight unit for aiming at a missile target and for receiving a tracking signal from the missile, and a generator for providing a reference signal.

In accordance with the teachings of this invention, means for producing a first envelope signal from the tracking signal is connected to the sight unit. An analog to digital converter converts the envelope signal and a reference signal into digital signals and inputs the digital signals into a microcontroller. The microcontroller calculates an error correction signal from the digital signals. A digital to analog converter converts the digital error correction signal to an analog error correction signal and outputs the analog signal to the system for use in computing a missile guidance signal.

BRIEF DESCRIPTION OF THE DRAWINGS

The various advantages of the present invention will become apparent to those skilled in the art after studying the following disclosure by reference to the drawings in which.

DETAILED DESCRIPTION

The following description of the preferred embodiments is merely exemplary in nature and is in no way intended to limit the invention or its application or uses.

Figure 1:
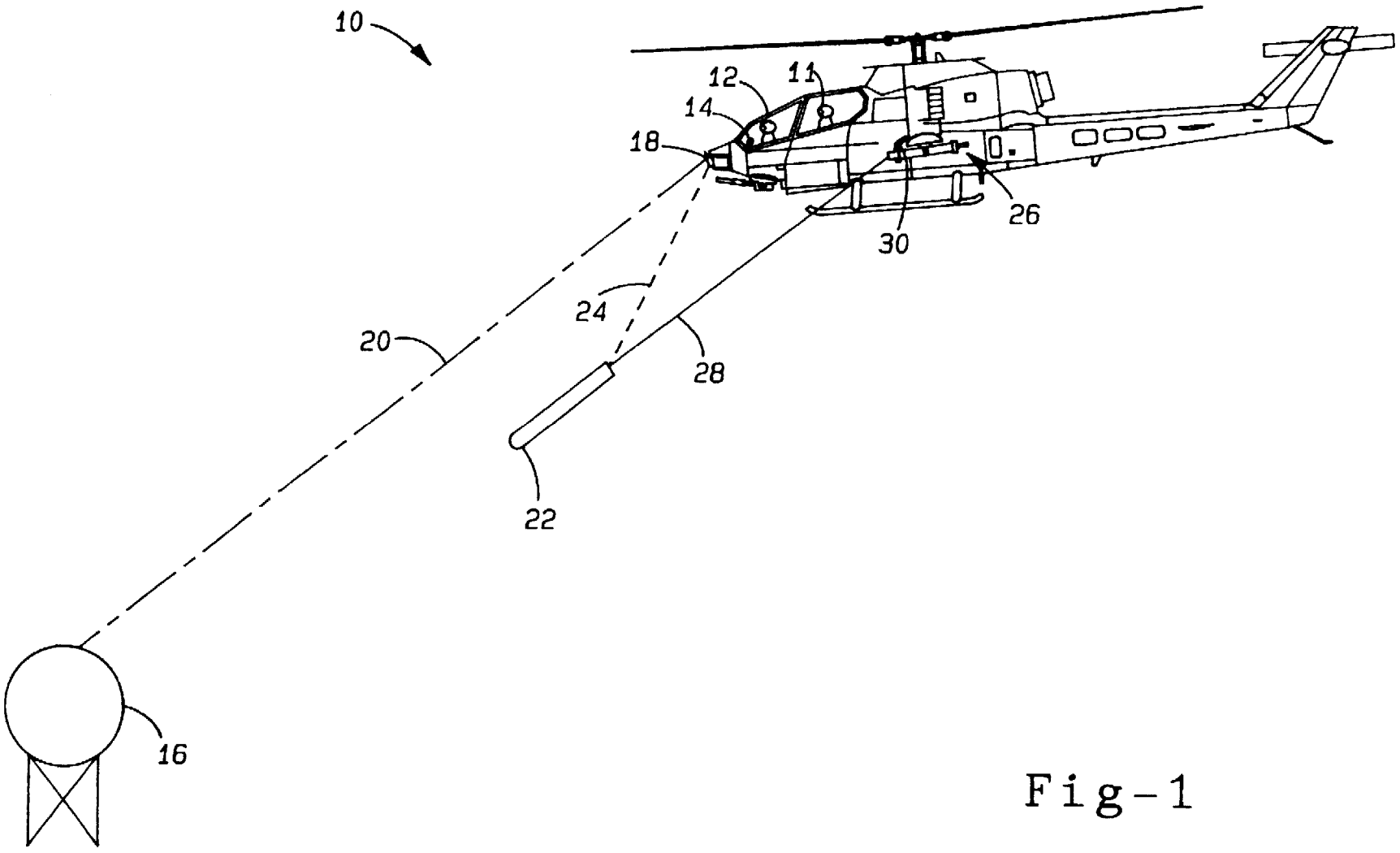
FIG. 1 is a side elevational view of an aircraft in which the present invention is implemented.

Referring to the drawings, FIG. 1 illustrates a side view of a helicopter, shown generally at 10, in which the present invention is implemented. Preferably, this is a AH-1 series Cobra attack helicopter. However, it is contemplated that the invention may also be implemented in a 500 MD series attack helicopter, or in other types of aircraft employing guided missile systems. As is shown, as pilot 11 flies the helicopter, system operator, or gunner 12, uses an eyepiece shown generally at 14, to locate missile target 16. System operator 12 uses eyepiece 14 to view an image of target 16 as detected by optics 18. Optics 18 are preferably of the type shown and described in detail in the aforementioned U.S. Pat. No. 3,989,947 to Chapman entitled "Telescope Cluster," which is assigned to Hughes Aircraft Company, the assignee of this invention and which is incorporated by reference herein.

As disclosed in Chapman, optics 18 detect the target, as represented by line 20. Tracking signal 24 is emitted by missile 22 after the missile is fired from missile firing mechanism 26. Typically, this tracking signal is the infrared radiation emitted from a source in the missile. Tracking signal 24 is processed by the missile guidance and tracking system as will be described in more detail below. The system uses the processed tracking signal to compute missile guidance signal 28, which is transmitted to the missile to keep the missile from deviating from its intended course. The missile guidance signal may be communicated to missile 22 via either a wire or wireless connection, dependant upon the type of system implemented, and is transmitted from the guidance and tracking system within aircraft 10 through external umbilical connection 30 and missile launcher 32 to missile 22 or an antenna.

Missile 22 is preferably a TOW missile implemented in one of the TOW missile systems well known to those skilled in the art. The present invention is preferably implemented in one of these TOW missile systems, such as the M-65 system that is shown for exemplary purposes in block diagram form in FIG. 2. While the block diagram in FIG. 2 illustrates an M-65 TOW missile system, it should be appreciated by those skilled in the art, upon reading the detailed description below, that the present invention may also be implemented in other TOW missile systems, such as the M-65, M-65/LAAT, M-65 C-NITE and TAMAM Night Targeting System (NTS or NTS-A) Systems and other aircraft-based missile and guidance tracking systems incorporating many of the same, or similar, components of the above-described M-65 TOW missile system.

The M-65 system, shown generally at 36, includes stabilization control amplifier (SCA) 38, telescopic sight unit (TSU) 40, having an error detector computer 42, and missile command amplifier (MCA) 44. SCA 38 sends pilot steering commands, indicated at 46, to head up display 47 to indicate to the pilot the position of the sighting optics with respect to the aircraft. SCA 38 receives, from pilot/gunner helmet sight 48, acquisition commands 50, representing target location when acquired using the helmet sight, and gunner commands 54 from sight hand control 52 for tracking target 16. In addition, SCA 38 also receives commands 56 from TOW control panel 58. These TOW control panel commands 56 result from pilot master arm commands 57, and system mode commands from gunner 12.

SCA 38 also receives data 60 concerning aircraft air speed from air speed sensor 62 and data 64 representing aircraft pitch angle and aircraft roll angle from aircraft vertical gyro sensor 66. In addition, SCA receives error signals 72 processed from data received from on gimbal elevation and azimuth gyros and accelerometers, and returns azimuth and elevation stabilization commands 72 to stabilize gimbal mounted telescope cluster (not shown) of TSU 40 and as disclosed in Chapman.

Figure 2:
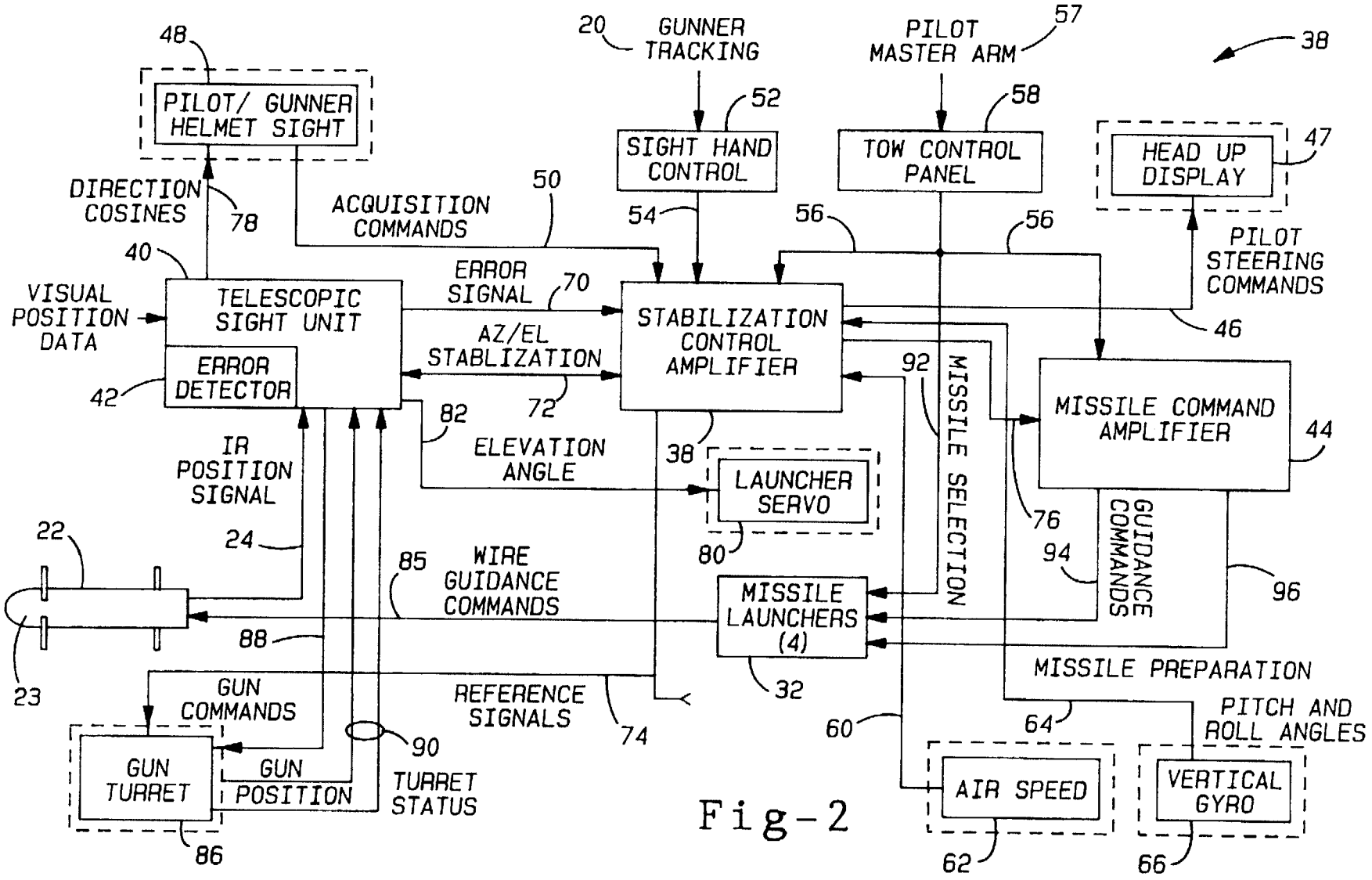
FIG. 2 is a simplified block diagram of a representative missile system in which the present invention is implemented.

Still referring to FIG. 2, TSU 40, in addition to being connected to SCA 38, is also connected to pilot/gunner helmet sight 48 for providing the sight with direction cosines 78 for target acquisition purposes. TSU 40 is also connected to launcher servo 80 to provide aircraft elevation angle data 82 to the servo to allow missile launcher 32 to be correctly positioned before firing missile 22. TSU 40 is also connected to gun turret 86 to provide gun position commands 88 and to receive gun position data 90 from turret 86.

Again referring to FIG. 2, in addition to receiving steering data from SCA 38 for output to missile 22, MCA 44 is connected to missile launchers 32 for missile selection as determined by TOW Control Panel "(TCP)" 58, or other controlling devices, at 92, for providing guidance commands 85 to missile launchers 32 through guidance commands 94 and for providing missile preparation commands 96, such as prefire signals, to missile 22 through missile launchers 32.

Figure 3:
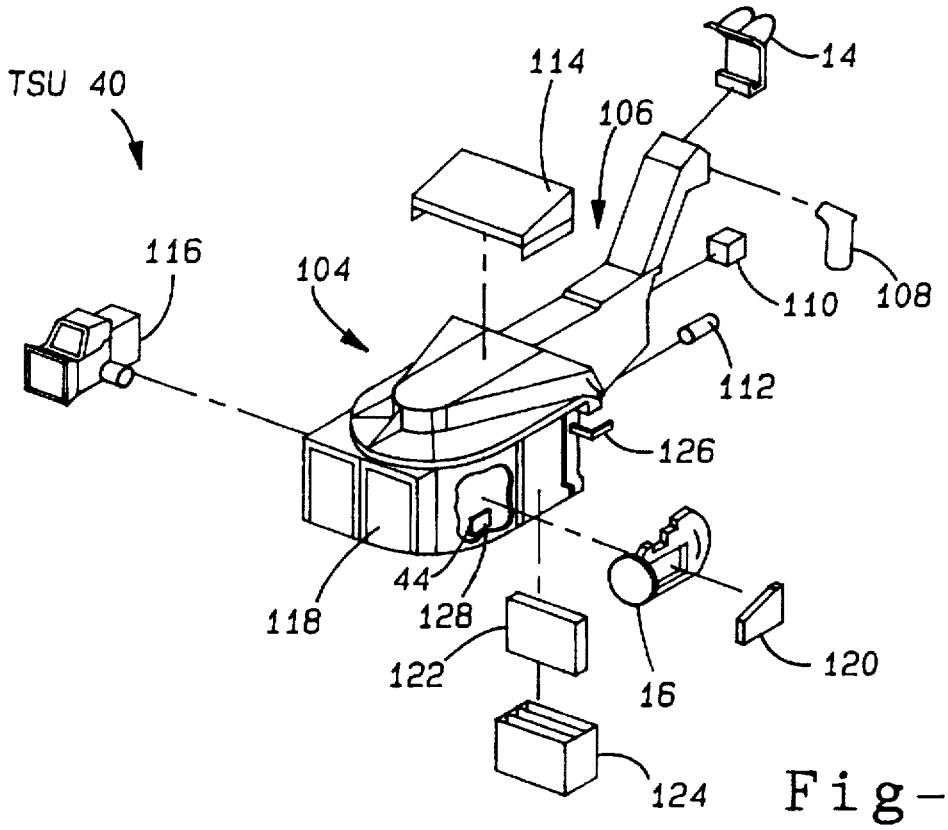
FIG. 3 is an exploded view of the telescopic sight unit of the missile system of FIG. 2.

Turning now to FIG. 3, an exploded view of telescopic sight unit 40 is shown. TSU 40 includes a main housing 104 and an arm 106 extending away from housing 104. Eyepiece 14 is housed in arm 106 and is used by gunner 12 to view missile target 18. Lefthand grip 108 is also positioned on arm 106 and corresponds to sight hand control 52 of FIG. 2. In the C-Nite system, a high voltage power supply 110 supplies power to TSU 40 and is located in arm 106 along with cathode ray tube 112. Laser electronics unit 114 is located on top of housing 104 and is used when a laser tracking missile system is used or for laser range finding. Forward looking infrared (FLIR) subassembly 116 is located in housing 104 and is implemented for target sighting and missile tracking purposes. In addition, telescope cluster 16 is mounted on stabilized gimbal 118 and is used for missile guidance and tracking purposes, as disclosed in U.S. Pat. No. 3,989,947 to Chapman, entitled "Telescopic Cluster." Additionally, heat exchanger 122 is inserted with the TSU/video electronics 124, in housing 104. Heat exchanger 122 disperses heat from electronics 124 through air ducts 126. Referring particularly to a C-NITE system, error detector computer 42 is located within housing 104, is in communication with cluster 16 and operates to generate an error signal as will be described in more detail below. Error detector computer implementation differs slightly in M-65 and NTS systems.

Figure 4:
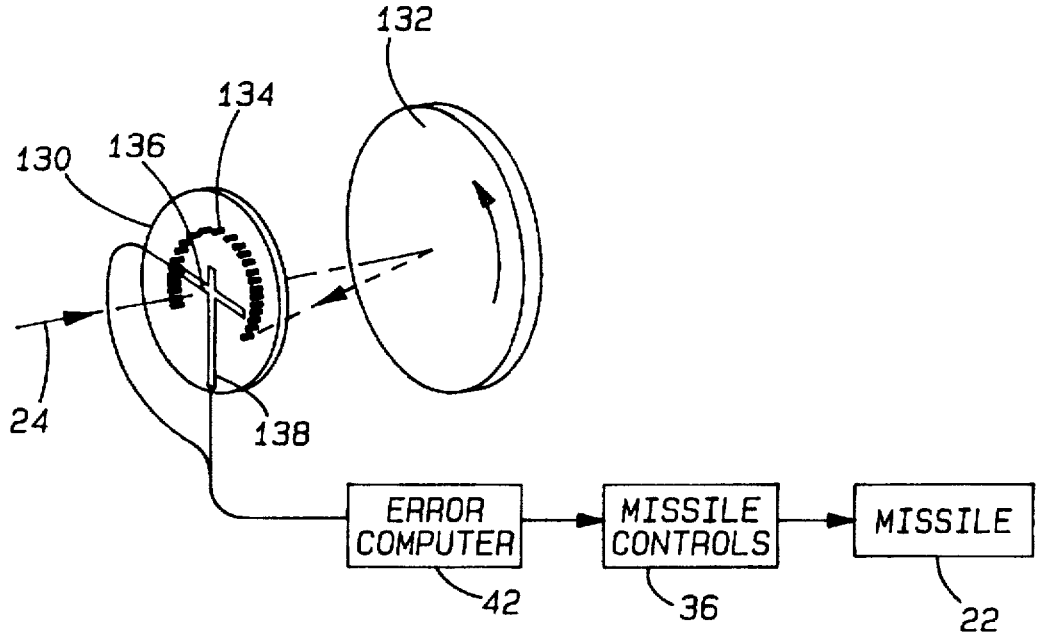
FIG. 4 is a perspective view diagrammatically illustrating a portion of a telescopic cluster of the telescopic sight unit of FIG. 3, along with a block diagram of o her portions of the system of FIG. 2.

Turning now to FIG. 4, a particular component of telescope cluster 16 is shown. As is disclosed by Chapman, gunner 12 views missile target 18 through a set of optical components, such as eyepiece 14, and telescope cluster 16. Telescope cluster 16 includes a set of optical components that track a signal emitted by missile 22 while the missile is in flight. Tracking signal 24 is detected through objective lens 130 and is focused to a point on motor driven rotating mirror 132. The point is then nutated to form a circle 134 at the focal point plane of objective lens 130.

An L-shaped detector is physically located at the focal plane of objective lens 130. Horizontal detector leg 136 corresponds to the azimuth channel and vertical detector leg 138 corresponds to the elevation channel of TSU 40, and also to the azimuth and elevation cross-hairs (not shown) used by gunner 12 to aim at missile target 16. Horizontal and vertical detector legs 136 and 138 detect the location of circle 134 with respect to the azimuth and elevation channels as circle 134 crosses each detector leg once during a rotation of mirror 132.

The center of circle 134 lies at the intersection of detector legs 136 and 138 if missile 22 is flying directly on course toward target 18. However, the exact position of missile 22 during its flight causes circle 134 to shift position with respect to detector legs 134 and 136. Missile position data detected by detector legs 136 and 138 is input to error detector computer 42 before being further processed by missile controls, indicated generally at 36 and as exemplified in the missile system in FIG. 2, and transmitted to missile 22 as missile guidance signal 28 used to steer the missile back on course.

Figure 5:
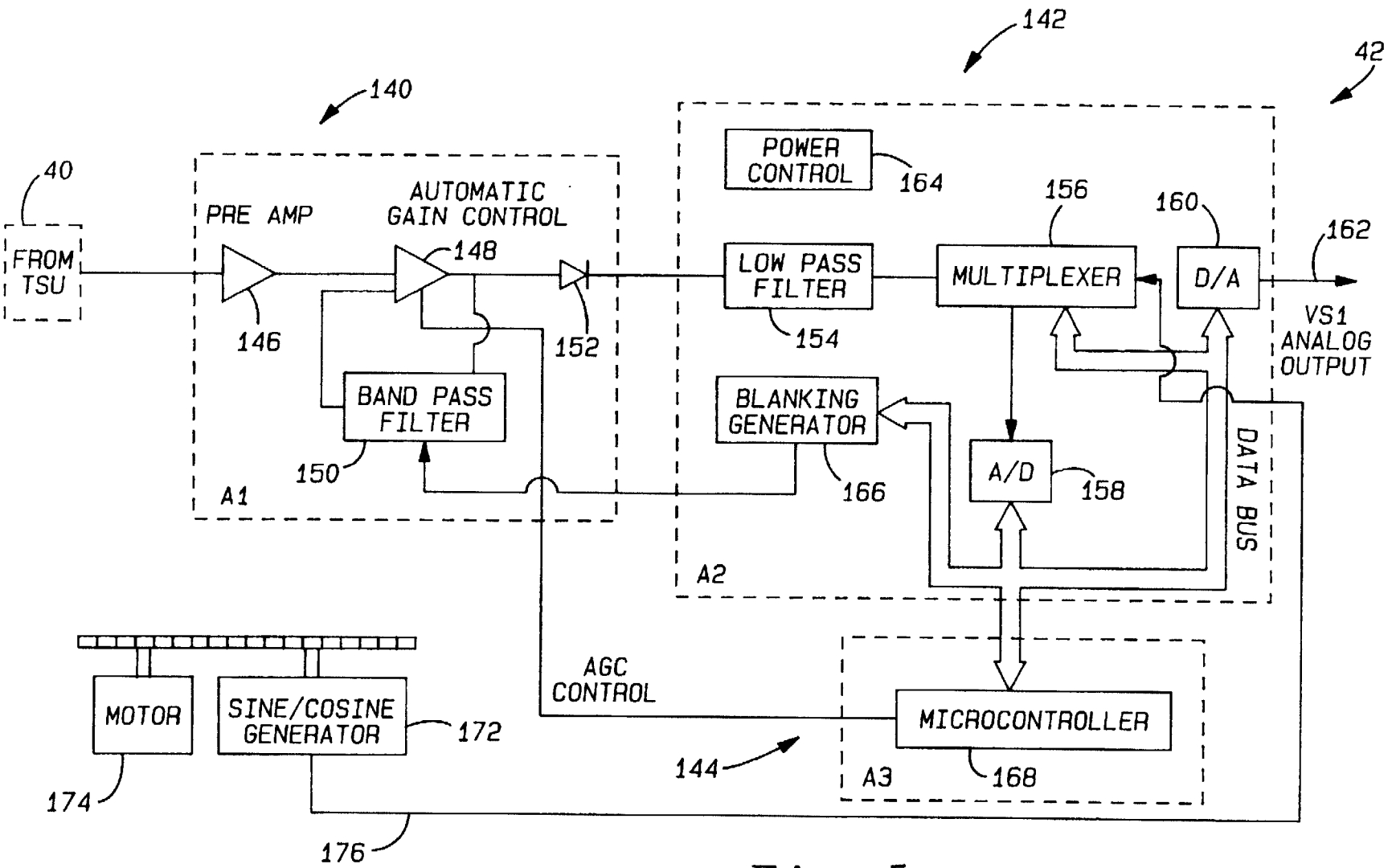
FIG. 5 is a simplified diagram, partially in schematic and partially in block form, of the error detector computer according to the present invention.

Turning now to FIG. 5, a block/schematic diagram of the error detector computer 42, the subject of the present invention, is shown generally at 42. Error detector computer 42 is implemented on three separate matched circuit cards 140, 142 and 144. Circuit card 140 includes preamplifier 146 for receiving input from TSU 40, automatic gain control amplifier 148 for receiving input from preamplifier 146, band pass filter 150 for passing only a predetermined segment of a signal from TSU 40, and transformer-coupled full wave rectifier 152 for rectifying signals passed from band pass filter 150.

Circuit board 142 includes low pass filter 154 that receives rectified signal output from diode 152, multiplexer 156 connected to the input of low pass filter 154 and to other components as described below, analog to digital converter 158 for receiving multiplexed signals from multiplexer 156, and digital to analog converter 160 for outputting analog error correction signal 162. In addition, circuit board 142 also contains power control 164 for supplying power to error computer 42, and blanking generator 166 for eliminating gain of band pass filter 150 during undesired portions of the scan circle.

Circuit card 144 contains microcontroller 168 which is connected by data bus to multiplexer 156, analog to digital converter 158, digital to analog converter 160 and blanking generator 166.

The system further includes a sine and cosine generator 172, driven by motor 174, for generating a reference signal that is put into multiplexer 156 through line 176 for reasons set forth in detail below.

At this point, it should be understood that a separate channel exists for each of the azimuth and elevation inputs. The rectified output from each channel is input to separate low pass filters 154 on circuit board 142. However, only one channel, corresponding to the signal of the azimuth channel, will be shown in FIG. 5 for descriptive purposes.

Figure 6A:
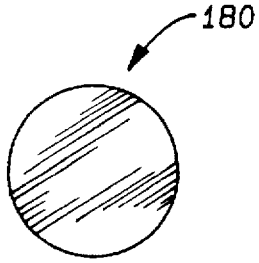
FIGS. 6A–6G are wave form diagrams illustrating a missile tracking signal and a reference signal, input to the error detector computer shown in FIG. 5, at various stages of processing.
Figure 6B:
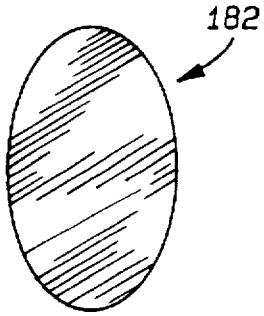
Figure 6C:
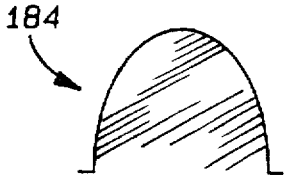

Referring to FIGS. 4, 5 and 6A–6G, operation of error detector computer 42 will now be described. As shown in FIG. 4, nutated circular signal 134 is input into error computer 42 through preamplifier 146 and output as an amplified wave form 180 as shown in FIG. 6A. Amplified wave form 140 represents an amplified version of a signal appearing in the azimuth channel of TSU 40. Next, band pass filter 150 passes only a predetermined segment of signal 180 through automatic gain control amplifier 148 to diode 152, resulting in signal 182 as shown in FIG. 6B. Signal 182 is rectified, resulting in signal 184, shown in FIG. 6C, being passed to low pass filter 154 on card 142.

Figure 6D:
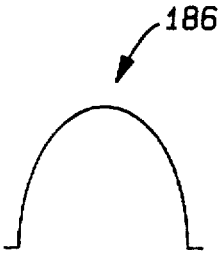
Figure 6E:
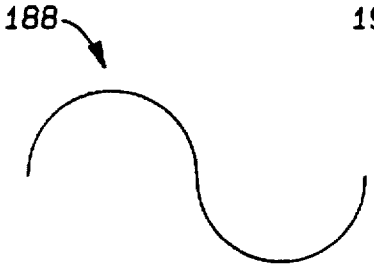

Low pass filter 154 filters noise and modulation frequencies from signal 184 and outputs an envelope signal, shown at 186 in FIG. 6D, in the shape of a pulse. The peak of signal 186 usually represents the location of missile 22 with respect to the azimuth axis. Next, pulse signal 186 is compared along with a signal, shown at 188 in FIG. 6E, from sine cosine generator 172, as will be described in more detail below, and then input into multiplexer 156 along with the reference signal. The resulting multiplexed signals are converted into digital signals in analog to digital converter 158 before being input into microcontroller 168 through data bus 170.

Figure 6F:
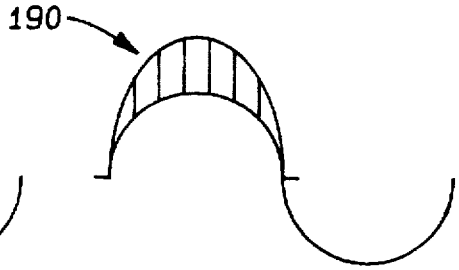
Figure 6G:
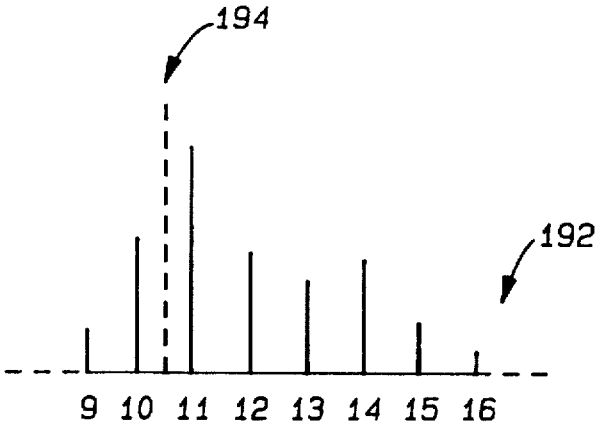

The microcontroller computes the centroid of the envelope signal by digitally sampling the reference and envelope signals. As shown in FIG. 6F (which shows the digital signals in analog form for illustrative purposes), microcontroller 168 samples envelope signal data beginning at a point where the digital envelope signal crosses the threshold of reference signal 188 and ends sampling when envelope signal 186 crosses back down over the reference signal threshold. From the sampled data, microcontroller 168, along with associated programmable software implemented at microcontroller 168, computes the value for the centroid of the envelope signal. If the centroid is computed as having a value between two sample values, such as between sample 10 and sample 11 of digital sampled signals as shown in FIG. 6G, microcontroller 168 interpolates between samples 10 and 11 and, by recalling a profile from a memory (not shown) associated with the microcontroller, interpolates to the value of the computed centroid at sample 10.5. The interpolated value for the centroid is then multiplied by a time variable gain profile, known by those skilled in the art as K(1)*T, to adjust the amplitude of the error correction signal to roughly correspond to the aircraft-to-missile distance.

Subsequent to being computed and multiplied by the time variable gain profile K(1)*T, the error signal value VS 1 is input into digital to analog converter 160 by via data bus 170. The resulting analog error signal is output at 162 for further processing to output a guidance signal through SCA 38 and MCA 44 to missile 22 to keep the missile on course.

At this point it should be appreciated that the error detector computer disclosed herein is designed for implementation in aircraft-based TOW missile systems, including but not limited to M-65 (as shown in FIG. 2), M-65/LAAT, M-65/C-NITE and Night Targeting System (NTS and NTS-A) TOW missile systems. It is also contemplated that this error detector computer could also be implemented in Land Vehicle missile systems such as Bradley Fighting Vehicle System (BFVS) or the GMHE Integrated TOW System (GITS). Implementation of the present invention eliminates many expensive analog hybrid components associated with prior devices used to perform error computation functions. Similarly, the present error detector computer eliminates the need for expensive, and often hard to obtain, analog components. The digital error detector computer exhibits a high degree of reliability and, because of its software-driven components, provides flexibility and provides for system growth capability. In addition, the error detector computer increases the accuracy and the probability that a missile launched from missile system will successfully reach its target and is compatible with existing analog-based test equipment.

Various other advantages of the present invention will become apparent to those skilled in the art after having the benefit of studying the foregoing text and drawings, taken in conjunction with the following claims.

What is claimed is:

1. An aircraft-based missile guidance and tracking system, including a sight unit for aiming at a missile target and for receiving a tracking signal from a missile, and a generator for providing a reference signal, comprising:

means for producing an envelope signal from said tracking signal;

an analog to digital converter for converting said envelope signal and said reference signal into digital reference signals;

a microcontroller, including a data bus, for calculating an error correction signal from said digital signals, said microcontroller being in communication with said analog to digital converter through said data bus; wherein said microcontroller calculates said error correction signal by sampling said digital reference and envelope signals to produce sampled signals, by calculating a centroid value of said envelope signal, computing a value between at least two of said sampled signals, and by interpolating between said sampled signals by recalling a profile from a memory stored in said microcontroller and further interpolating to said centroid value to produce an error correction signal; and a digital to analog converter for converting said digital error correction signal to an analog error correction signal and for outputting said analog signal to said system, for use in computing a missile guidance signal.

2. The system of claim 1, wherein said means for producing the envelope signal from said tracking signal comprises:

a band pass filter for outputting a signal of predetermined frequency of the tracking signal;

a rectifier for receiving and rectifying said output signal from said band pass filter; and a low pass filter for receiving said rectified signal from said rectifier, for removing modulation frequencies from said rectified frequency and for outputting said envelope signal.

3. The system of claim 1, further comprising:

a modulator for modulating said tracking signal emitted from said missile; and a detector for receiving said modulated signal from said modulator and for relaying said signal to said means for producing an envelope signal.

4. The system of claim 3, wherein said detector comprises a first detector leg connected to an azimuth channel and a second detector leg connected to an elevation channel of said sight unit.

5. An aircraft-based missile guidance and tracking system, including a sight unit for aiming at a missile target and for receiving a tracking signal from a missile, and a generator for providing a reference signal, comprising:

means for producing an envelope signal from said tracking signal;

an analog to digital converter for converting said envelope signal and said reference signal into digital reference signals;

a microcontroller, including a data bus, for calculating an error correction signal from said digital signals, said microcontroller being in communication with said analog to digital converter through said data bus; wherein said microcontroller calculates said error correction signal by sampling said digital reference and envelope signals to produce sampled signals, by calculating a centroid value of said envelope signal, computing a value between at least two of said sampled signals, and by interpolating between said sampled signals by recalling a profile from a memory stored in said microcontroller and further interpolating to said centroid value to produce an error correction signal; and a digital to analog converter for converting said digital error correction signal to an analog error correction signal and for outputting said analog signal to said system, for use in computing a missile guidance signal, wherein said error correction signal is multiplied by a time variable gain profile representative of aircraft to missile distance.

6. An aircraft-based missile guidance and tracking system, including a sight unit for aiming at a missile target and for receiving a tracking signal from a missile, and a generator for providing a reference signal, comprising:

means for producing an envelope signal from said tracking signal;

an analog to digital converter for converting said envelope signal and said reference signal into digital reference signals;

a microcontroller, including a data bus, for calculating an error correction signal from said digital signals, said microcontroller being in communication with said analog to digital converter through said data bus;

wherein said microcontroller calculates said error correction signal by sampling said digital reference and envelope signals to produce sampled signals, by calculating a centroid value of said envelope signal, computing a value between at least two of said sampled signals, and by interpolating between said sampled signals by recalling a profile from a memory stored in said microcontroller and further interpolating to said centroid value to produce an error correction signal; and a digital to analog converter for converting said digital error correction signal to an analog error correction signal and for outputting said analog signal to said system, for use in computing a missile guidance signal, wherein said error correction signal is multiplied by a time variable gain profile representative of aircraft to missile distance, wherein said time variable gain profile is stored in a memory in said microcontroller.

7. An aircraft-based missile guidance and tracking system, including a sight unit for aiming at a missile target and for receiving a tracking signal from a missile, and a generator for providing a reference signal, comprising:

means for producing an envelope signal from said tracking signal;

an analog to digital converter for converting said envelope signal and said reference signal into digital reference signals;

a microcontroller, including a data bus, for calculating an error correction signal from said digital signals, said microcontroller being in communication with said analog to digital converter through said data bus; wherein said microcontroller calculates said error correction signal by sampling said digital reference and envelope signals to produce sampled signals, by calculating a centroid value of said envelope signal, computing a value between at least two of said sampled signals, and by interpolating between said sampled signals by recalling a profile from a memory stored in said microcontroller and further interpolating to said centroid value to produce an error correction signal; and a digital to analog converter for converting said digital error correction signal to an analog error correction signal and for outputting said analog signal to said system, for use in computing a missile guidance signal, further comprising:

a preamplifier for amplifying said tracking signal; and an automatic gain control amplifier for receiving said amplified tracking signal from said preamplifier and for multiplying said interpolated signal value by a time variable gain profile to produce said error correction signal at said microcontroller.

8. An aircraft-based missile guidance and tracking system, including a sight unit for aiming at a missile target and for receiving a tracking signal from a missile, and a generator for providing a reference signal, comprising:

means for producing an envelope signal from said tracking signal;

an analog to digital converter for converting said envelope signal and said reference signal into digital reference signals;

a microcontroller, including a data bus, for calculating an error correction signal from said digital signals, said microcontroller being in communication with said analog to digital converter through said data bus; wherein said microcontroller calculates said error correction signal by sampling said digital reference and envelope signals to produce sampled signals, by calculating a centroid value of said envelope signal, computing a value between at least two of said sampled signals, and by interpolating between said sampled signals by recalling a profile from a memory stored in said microcontroller and further interpolating to said centroid value to produce an error correction signal; and a digital to analog converter for converting said digital error correction signal to an analog error correction signal and for outputting said analog signal to said system, for use in computing a missile guidance signal, further comprising:

a preamplifier for amplifying said tracking signal; and an automatic gain control amplifier for receiving said amplified tracking signal from said preamplifier and for multiplying said interpolated signal value by a time variable gain profile to produce said error correction signal at said microcontroller, wherein said preamplifier, said automatic gain control amplifier, a band pass filter and a rectifier are located on a first circuit card.

9. An aircraft-based missile guidance and tracking system, including a sight unit for aiming at a missile target and for receiving a tracking signal from a missile, and a generator for providing a reference signal, comprising:

means for producing an envelope signal from said tracking signal;

an analog to digital converter for converting said envelope signal and said reference signal into digital reference signals;

a microcontroller, including a data bus, for calculating an error correction signal from said digital signals, said microcontroller being in communication with said analog to digital converter through said data bus; wherein said microcontroller calculates said error correction signal by sampling said digital reference and envelope signals to produce sampled signals, by calculating a centroid value of said envelope signal, computing a value between at least two of said sampled signals, and by interpolating between said sampled signals by recalling a profile from a memory stored in said microcontroller and further interpolating to said centroid value to produce an error correction signal; and a digital to analog converter for converting said digital error correction signal to an analog error correction signal and for outputting said analog signal to said system, for use in computing a missile guidance signal, further comprising:

a preamplifier for amplifying said tracking signal; and an automatic gain control amplifier for receiving said amplified tracking signal from said preamplifier and for multiplying said interpolated signal value by a time variable gain profile to produce said error correction signal at said microcontroller, wherein said preamplifier, said automatic gain control amplifier, said band pass filter and said rectifier are located on a first circuit card, wherein a low pass filter, a multiplexer, said analog to digital converter and said digital analog converter are located on a second circuit card.

10. An aircraft-based missile guidance and tracking system, including a sight unit for aiming at a missile target and for receiving a tracking signal from a missile, and a generator for providing a reference signal, comprising:

means for producing an envelope signal from said tracking signal;

an analog to digital converter for converting said envelope signal and said reference signal into digital reference signals;

a microcontroller, including a data bus, correction sign an error correction signal from said digital signals, said microcontroller being in communication with said analog to digital converter through said data bus; wherein said microcontroller calculates said error correction signal by sampling said digital reference and envelope signals to produce sampled signals, by calculating a centroid value of said envelope signal, computing a value between at least two of said sampled signals, and by interpolating between said sampled signals by recalling a profile from a memory stored in said microcontroller and further interpolating to said centroid value to produce an error correction signal; and a digital to analog converter for converting said digital error correction signal to an analog error correction signal and for outputting said analog signal to said system, for use in computing a missile guidance signal, further comprising:

a preamplifier for amplifying said tracking signal; and an automatic gain control amplifier for receiving said amplified tracking signal from said preamplifier and for multiplying said interpolated signal value by a time variable gain profile to produce said error correction signal at said microcontroller, wherein said preamplifier, said automatic gain control amplifier, said band pass filter and said rectifier are located on a first circuit card, wherein said loss pass filter, said multiplexer, said analog to digital converter and said digital analog converter are located on a second circuit card, further comprising a blanking generator for the elimination of false signal peaks due to noise and scene clutter.

11. An aircraft based missile guidance and tracking system for directing a missile to a target, comprising:

means for aiming at said missile target;

means for receiving a tracking signal from said missile;

a generator for providing a reference signal;

means for measuring aircraft and missile position data;

means for inputting commands, said means for inputting commands being in communication with said aiming means, a tracking means and said data measuring means;

means for generating guidance signals for guiding said missile to said missile target;

and an error detector computer, including;

means for producing a first envelope signal from said tracking signal;

an analog to digital converter for converting said envelope signal and said reference signal into digital reference signals;

a microcontroller, including a data bus, for calculating an error correction signal from said digital signals, said microcontroller being in communication with said analog to digital converter through said data bus; and a digital to analog converter for converting a digital error correction signal to an analog error correction signal and for outputting said analog signal to system, for use in computing a missile guidance signal, wherein said microcontroller calculates said digital error correction signal by sampling said digital reference and envelope signals to produce sampled signals, by calculating a centroid value sampled of said envelope signal, and by interpolating from said sampled signals to said centroid value to produce an error correction signal.

12. The system of claim 11, further comprising:

a preamplifier for amplifying said tracking signal; and an automatic gain control amplifier for receiving said amplified tracking signal from said preamplifier and for multiplying said interpolated signal value by a time variable gain profile to produce said error correction signal at said microcontroller.

13. The system of claim 11, wherein said means for producing an envelope signal from said tracking signal comprises:

a band pass filter for outputting a signal of predetermined frequency for the tracking signal;

a rectifier for receiving and rectifying said output signal from said band pass filter; and a low pass filter for receiving said rectified signal from said rectifier, for removing modulation frequencies from a rectified frequency and for outputting said envelope signal.

14. The system of claim 11, further comprising:

a modulator for modulating said tracking signal emitted from said missile; and a detector for receiving said modulated signal from said modulator and for relaying said signal to said means for producing an envelope signal.

15. The system of claim 14, wherein said detector comprises a first detector leg connected to an azimuth channel and a second detector leg connected to an elevation channel of said sight unit.

16. An aircraft based missile guidance and tracking system for directing a missile to a target, comprising:

means for aiming at said missile target;

means for receiving a tracking signal from said missile;

a generator for providing a reference signal;

means for measuring aircraft and missile position data;

means for inputting commands, said means for inputting commands being in communication with said aiming means, a tracking means and said data measuring means;

means for generating guidance signals for guiding said missile to said missile target;

and an error detector computer, including;

means for producing a first envelope signal from said tracking signal;

an analog to digital converter for converting said envelope signal and said reference signal into digital reference signals;

a microcontroller, including a data bus, for calculating an error correction signal from said digital signals, said microcontroller being in communication with said analog to digital converter through said data bus; and a digital to analog converter for converting a digital error correction signal to an analog error correction signal and for outputting said analog signal to system, for use in computing a missile guidance signal, wherein said microcontroller calculates said error correction signal by sampling said digital reference and envelope signals to produce sampled signals, by calculating a centroid value sampled of said envelope signal, and by interpolating from said sampled signals to said centroid value to produce an error correction signal, wherein said interpolated signal is multiplied by a time variable gain profile representative of aircraft to missile distance.

17. An aircraft based missile guidance and tracking system for directing a missile to a target, comprising:

means for aiming at said missile target;

means for receiving a tracking signal from said missile;

a generator for providing a reference signal;

means for measuring aircraft and missile position data;

means for inputting commands, said means for inputting commands being in communication with said aiming means, a tracking means and said data measuring means;

means for generating guidance signals for guiding said missile to said missile target;

and an error detector computer, including;

means for producing a first envelope signal from said tracking signal;

an analog to digital converter for converting said envelope signal and said reference signal into digital reference signals;

a microcontroller, including a data bus, for calculating an error correction signal from said digital signals, said microcontroller being in communication with said analog to digital converter through said data bus; and a digital to analog converter for converting a digital error correction signal to an analog error correction signal and for outputting said analog signal to system, for use in computing a missile guidance signal, wherein said microcontroller calculates said error correction signal by sampling said digital reference and envelope signals to produce sampled signals, by calculating a centroid value sampled of said envelope signal, and by interpolating from said sampled signals to said centroid value to produce an error correction signal, wherein said interpolated signal is multiplied by a time variable gain profile representative of aircraft to missile distance, wherein said time variable gain profile is stored in a memory in said microcontroller.

18. In an aircraft-based missile guidance and tracking system, including a sight unit for aiming at a missile target and for receiving a tracking signal from a missile, and a generator for providing a reference signal, a method for guiding said missile, comprising the steps of:

providing a microcontroller for performing error correction calculations;

receiving a first tracking signal from said missile;

producing an envelope signal from said tracking signal;

converting said envelope signal and said reference signal to digital envelope and reference signals for input to said microcontroller;

sampling said digital signals;

interpolating said sampled signals to generate said centroid value to determine said error correction signal wherein said microcontroller calculates an error correction signal by sampling said digital reference and envelope signals to produce sampled signals, by calculating a centroid value of said envelope signal, computing a value between at least two of said sampled signals, and by interpolating between said sampled signals by recalling a profile from a memory stored in said microcontroller and further interpolating to said centroid value to produce an error correction signal; and converting said interpolated error correction signal into an analog error correction signal for output to said system for computation of a missile guidance signal.

19. The method of claim 18, further comprising the step of producing a second envelope signal from said tracking signal, said first and second envelope signals corresponding to signals sensed by detectors in azimuth and elevation channels of said sight unit.

20. The method of claim 18, further comprising the steps of:

storing a digital reference signal at said microcontroller before said step of computing said centroid for said envelope signal; and recalling said stored digital reference signal after said step of computing a centroid value for said envelope signal.

21. The method of claim 18, further comprising the step of amplifying said interpolated signal by a time variable gain profile to produce said error correction signal.

22. The method of claim 18, wherein said step of producing an envelope signal from said tracking signal comprises the steps of:

passing only a predetermined frequency of said tracking signal;

rectifying said predetermined frequency of said tracking signal; and filtering said rectified tracking signal to produce said envelope signal.

* * * * *